United States Patent [19]

Arcouette

[11] 4,167,050

[45] Sep. 11, 1979

[54] VERTICAL STABILIZER FOR KAYAK

[76] Inventor: Pierre Arcouette, 39 Montagne St. - Apt. 21, Granby, Quebec, Canada

[21] Appl. No.: 915,535

[22] Filed: Jun. 14, 1978

[51] Int. Cl.[2] ..... A45F 3/15

[52] U.S. Cl. ..... 9/1.4; 114/126

[58] Field of Search ..... 9/1.4, 1.1, 2 R, 2 C, 9/2 S, 2 A, 2 F, 6 R, 6 M, 6 P, 6 W, 5, 310 R, 310 E; 114/219, 56, 220, 59, 40, 41, 126, 127, 132; 272/1 B; D12/11, 63, 62, 70

[56] References Cited

U.S. PATENT DOCUMENTS

| | | | |
|---|---|---|---|
| 461,759 | 10/1891 | Koch | 114/219 |
| 1,631,047 | 5/1927 | Meyer | 9/2 A |
| 1,649,311 | 11/1927 | Kaechele et al. | 9/1.4 |
| 3,374,495 | 3/1968 | Joyce | 9/310 E |

*Primary Examiner*—Jesus D. Sotelo

[57] ABSTRACT

A vertical stabilizer adapted to fit the rear pointed end of a kayak. The stabilizer includes a hollow body which is flared to engage over the rear pointed end of a kayak and a vertical stabilizer plane integrally formed, and depending from, the body. An elastic band is connected to the body and to the kayak and biases the stabilizer into either a raised inoperative position and a lowered operative position.

2 Claims, 6 Drawing Figures

VERTICAL STABILIZER FOR KAYAK

This invention relates to a kayak implement, and more particularly, to the rear device of the type adapted to be placed on a pointed end of a kayak and providing a vertical stabilizer plane for stabilizing the kayak against unwanted turning.

It is a general object of the present invention to provide a vertical stabilizer of the above type which is of simple construction and simply fits on the pointed end of a kayak.

It is still another object of the present invention to provide a vertical stabilizer selectively pivotable between an operative and an inoperative position.

The above and other objects and advantages of the present invention will be better understood with reference to the following detailed description of preferred embodiments thereof which are illustrated, by way of example, in the accompanying drawings, in which.

Figure 1:
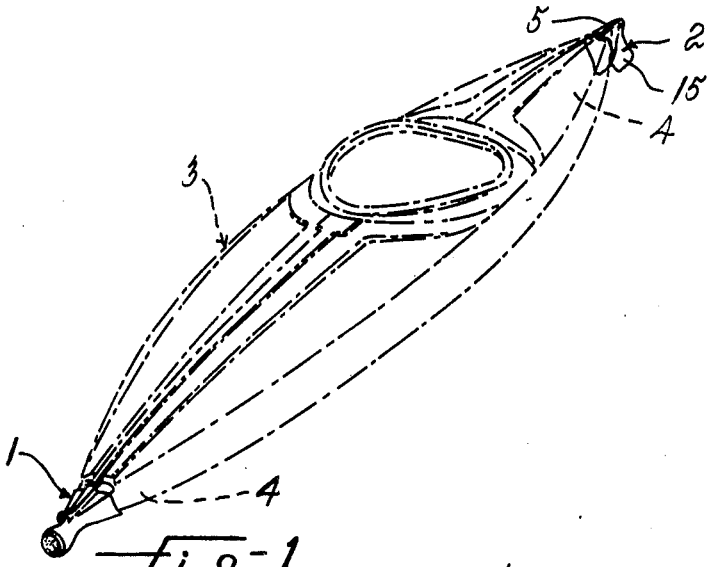
FIG. 1 is a perspective view of a kayak shown in dashed lines and provided at its rear end with a vertical stabilizer according to the present invention; a bumper device, not part of the invention, is shown fitted on the front end of the kayak.

As shown in FIG. 1, a shock-absorbing device 1 and a vertical stabilizer 2 are mounted on the opposite pointed front and rear ends 4 of a kayak 3. The shock absorber device 1 forms no part of the present invention.

Figure 3:
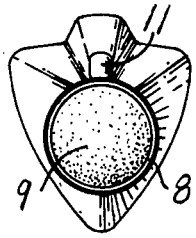
FIGS. 2, 3, 4 and 5 are side, left end, right end, and bottom views respectively of the vertical stabilizer according to the present invention.
Figure 2:
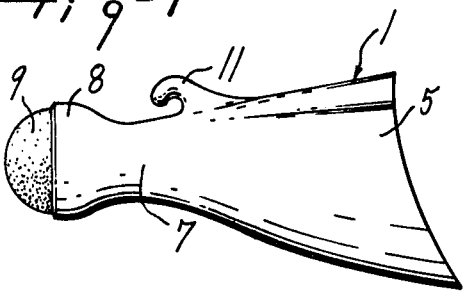
Figure 4:
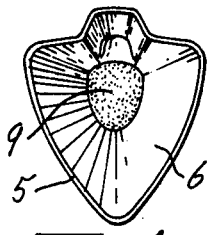
Figure 5:
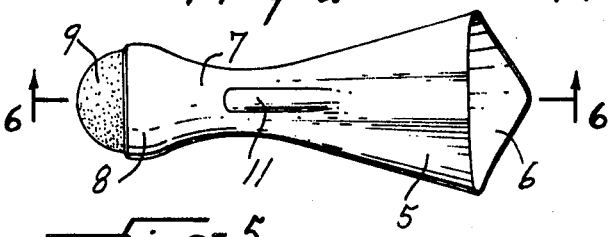
Figure 6:
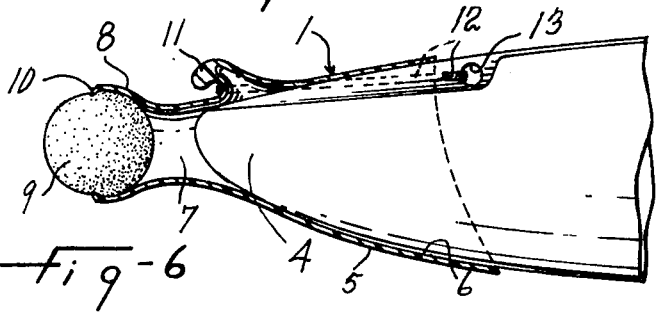
FIG. 6 is a side elevation view of the vertical stabilizer end device shown partially in longitudinal section and operatively mounted on the rear pointed end of a kayak.
Figure 3:
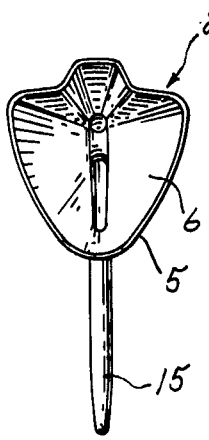
Figure 2:
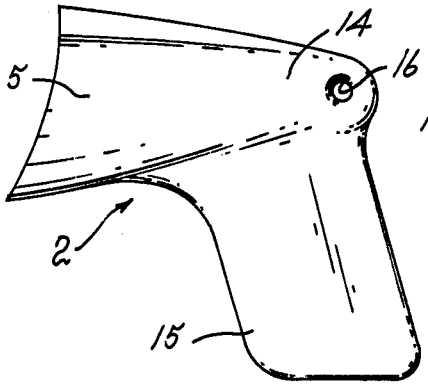
Figure 4:
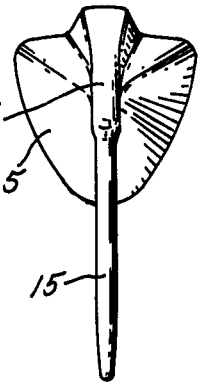
Figure 5:
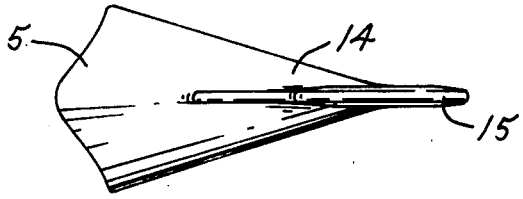
Figure 6:
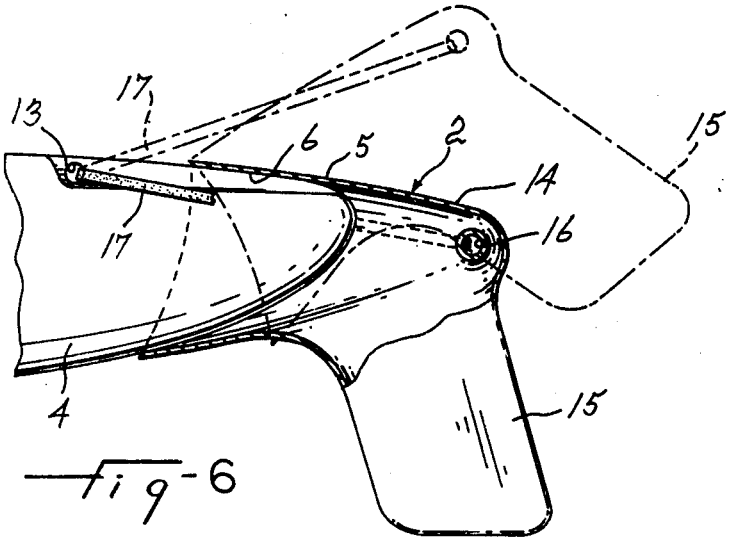

The vertical stabilizer end device 2 is molded in a one piece and includes a hollow body defining a flared base portion 5 open at its outer end and a tapered opposite end portion 14 from which downwardly depends a stabilizer plane 15. The base portion 5 defines an inner cavity 6, of non-circular cross-section, as shown in FIG. 3, and which is complementarily shaped relative to the pointed end 4 of the kayak to allow engagement of the pointed end 4 therein. The outer end of the opposite end portion 14 is formed with a hole 16 operatively spaced outward from the hole 13 in the corresponding end 4 of the kayak. An elastic band 17 passes through the holes 13 and 16 to operatively bias the vertical stabilizer end device 2 in position on the corresponding pointed end 4 of a kayak. The stabilizer plane 15 is positively retained in downwardly extending position.

As shown in FIG. 11, the vertical stabilizer end device 2 may be displaced between a lowered operative position shown in full lines and an elevated inoperative position shown in dashed lines. In either position, the vertical stabilizer end device 2 is held in place under the bias of the elastic band 17. The displacement to either position is easily made with the end of the paddle by the user without having to move out of his seating position.

What I claim is:

1. A vertical stabilizer for a kayak comprising a hollow body molded in one piece and including an open, flared base end portion defining a cavity complementarily shaped relative to a pointed end of a kayak and allowing engagement of said pointed end therein, said cavity having a non-circular cross-section, said body further including an opposite end portion adapted to project outwardly of said pointed end of the kayak, a stabilizer plane operatively projecting downwardly from said opposite end portion and integrally molded with said body, and a connection removably securing said body to said kayak with said flared end portion in operative engagement over said pointed end of the kayak.

2. A vertical stabilizer as claimed in claim 1, wherein said body is pivotable on the pointed end of said kayak between a lowered stabilizing and an elevated inoperative position, and said connection includes an elastic band connected to said body and to said kayak and biasing the body in either one of said stabilizing and inoperative position.

* * * * *